US006605817B1

(12) United States Patent
Nihei et al.

(10) Patent No.: US 6,605,817 B1
(45) Date of Patent: Aug. 12, 2003

(54) NEUTRON SHIELD AND CASK THAT USES THE NEUTRON SHIELD

(75) Inventors: Kiyoshi Nihei, Hyogo (JP); Kenji Najima, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 218 days.

(21) Appl. No.: 09/686,875

(22) Filed: Oct. 12, 2000

(30) Foreign Application Priority Data

Oct. 13, 1999 (JP) ..... 11-291664

(51) Int. Cl.[7] ..... G21C 11/00
(52) U.S. Cl. ..... 250/518.1
(58) Field of Search ..... 250/515.1, 518.1, 250/506.1

(56) References Cited

U.S. PATENT DOCUMENTS 4,230,660 A 10/1980 Taylor et al.
6,517,743 B2 * 2/2003 Anayama et al. ..... 252/478

FOREIGN PATENT DOCUMENTS

| | | |
|---|---|---|
| EP | 0 108 622 | 5/1984 |
| FR | 2 473 213 | 7/1981 |
| GB | 1 603 729 | 11/1981 |
| JP | 4-45124 | 2/1992 |
| JP | 6-148388 | 5/1994 |
| JP | 6-180388 | 6/1994 |

OTHER PUBLICATIONS

Patent Abstracts of Japan, vol. 015, No. 156 (P–1192), Apr. 18, 1991, JP 03 025398, Feb. 4, 1991.
Derwent Publications, AN 1985–285715, JP 60 194394, Oct. 2, 1985.
Derwent Publications, AN 1987–069795, JP 62 024197, Feb. 2, 1987.
Derwent Publications, AN 1988–143828, JP 63 085497, Apr. 15, 1988.
Patent Abstracts of Japan, vol. 017, No. 221 (C–1054), May 7, 1993, JP 04 359070, Dec. 11, 1992.
Derwent Publications, AN 1987–309578, JP 62 217199, Sep. 24, 1987.
Derwent Publications, AN 1988–239273, JP 63 173000, Jul. 16, 1988.

* cited by examiner

*Primary Examiner*—John R. Lee
*Assistant Examiner*—James J. Leybourne
(74) *Attorney, Agent, or Firm*—Oblon, Spivak, McClelland, Maier & Neustadt, P.C.

(57) ABSTRACT

A neutron shield formed by blending two-part reactive cold-setting epoxy resin consisting of long-chain aliphatic glycidyl ether epoxy resin containing reactive diluent as main component, and a mixture of alicyclic polyamine, polyamide polyamine, aliphatic polyamine and epoxy adduct as hardener of the two-part reactive cold-setting epoxy resin, aluminum hydroxide of high purity with impurity soda content of 0.07% by weight or less, and boron carbide is used as resin of a cask.

13 Claims, 3 Drawing Sheets

NEUTRON SHIELD AND CASK THAT USES THE NEUTRON SHIELD

FIELD OF THE INVENTION

The present invention in general relates to a neutron shield and a cask that uses the neutron shield. More particularly, this invention relates to a neutron shield capable of enhancing the working efficiency by lowering the viscosity in uncured state and maintaining a sufficient pot life, and also maintaining an excellent heat resistance and neutron shielding capacity. Further, this invention relates to a cask that stores the spent fuel assemblies in the neutron shield.

BACKGROUND OF THE INVENTION

In the background of recent progress in nuclear industries, various nuclear facilities including reactors and fuel reprocessing plants are built around the world, and at these nuclear installations, maximum caution is required to minimize the radiation dose exposed to the human, and avoid loss and damage of structural members and equipment materials due to radiation. The neutrons released from the fuel and spent fuel at nuclear facilities are high in energy, and can pass through material. They generate gamma-rays when they collide with other substance. The radiated gamma-rays may cause serious human casualties and damages of nuclear facilities and materials. As a consequence, neutron shields capable of shielding neutrons safely and securely are being developed continuously.

Concrete is generally used to shield the neutron s. However, when concrete is to be used for such purpose the thickness of the wall has to be made considerably thick. This is a disadvantage in nuclear facilities such as atomic-powered ship because most of them have to light weighted and small and compact. Accordingly, there is a requirement of lightweight neutron shields.

Faster neutrons, among other neutrons, are effectively decelerated when they collide with hydrogen atoms of nearly same mass. Therefore, substance of high hydrogen density, that is, high hydrogen content, can effectively shield the faster neutrons. Accordingly, water, paraffin or polyethylene may be used as the neutron shielding material. Water is lighter in weight than concrete. However, because water is a liquid, it is difficult to handle. Furthermore, the water has to be stored into a container and neutron shielding capability of the material of the container becomes another problem.

On the other hand, it is proposed to form neutron shields by using lightweight materials high in hydrogen content and excellent in neutron decelerating effect, such as paraffin, polyethylene, other polyolefin thermoplastic resins, unsaturated polyester resin and other thermosetting resins, and polymethacrylic acid, either independently or in mixture, or these materials blended with boron compound known to have a wide absorbing sectional area in slow and thermal neutrons, such as paraffin containing boron compound, polyethylene containing boron compound, and ester polymethacrylate containing boron compound.

Recently, a new neutron shield is formed by using epoxy resin, and blending with a huge volume of aluminum hydroxide as refractory, and a trace of boron carbide as neutron shielding material. The epoxy resin is usually a two-part reactive cold-setting epoxy resin consisting of main component and hardener, and the main component is bisphenol A type main component (hydrogen content=7.1% by weight) with epoxy equivalent of 184 to 194 and molecular weight of about 380, and the hardener is aliphatic polyamine, alicyclic polyamine, polyamide amine, and epoxide adduct, which may be used either alone or in mixture.

When forming the neutron shield by using such two-part reactive cold-setting epoxy resin consisting of main component and hardener, in order to obtain a uniform neutron shield by homogeneously mixing the epoxy resin main component, hardener, aluminum hydroxide, and boron carbide, it required long kneading and filling work of about 30 minutes in small units. In this case, since the hardener is contained in the kneaded neutron shield, it may get solidified unless poured in promptly, and the working efficiency is poor because the viscosity is high. That is, owing to high viscosity, the fluidity in the hose is poor when pouring in, and the pouring amount per unit time is small, and still more, because of kneading in small units, the number of times of interruption in the pouring process increases when manufacturing a large-sized neutron shield, and the total pouring process takes much time and labor.

Incidentally, the pot life of the neutron shield mixing such two-part reactive cold-setting epoxy resin varies with the passing of the kneading time, but it is generally 2 hours when the initial temperature is about 30° C. in kneading process. This duration of 2 hours includes the kneading and filling time, for example, 30 minutes as mentioned above, and it is demanded to shorten the kneading and filling time by lowering the viscosity. The pot life means, in this case, the duration from the fluid state by kneading until a minimum fluidity necessary for pouring is left over.

On other hand, the aluminum hydroxide contained in the neutron shield mentioned above is high in hydrogen content and is intended to give flame retardant property and neutron shielding capability, but when exposed to high temperature environment for a long time, the hydrogen content declines gradually.

SUMMARY OF THE INVENTION

It is an object of this invention to provide a neutron shield capable of enhancing the working efficiency by lowering the viscosity when forming the neutron shield, and maintaining enough hydrogen content for assuring heat resistance and neutron shielding capability even in high temperature environment for a long period after forming the neutron shield. It is another object of this invention to provide a cask that uses this neutron shield.

The neutron shield according to one aspect of this invention has a two-part reactive cold-setting epoxy resin consisting of an epoxy resin adding long-chain aliphatic glycidyl ether epoxy resin as main component, and alicyclic polyamine, polyamide aliphatic polyamine and epoxy adduct as hardener. Since the long-chain aliphatic glycidyl ether epoxy resin containing reactive diluent is used as the main component, the viscosity can be lowered to about 20 to 25 poise, and therefore, the working efficiency is enhanced. Furthermore, the hydrogen content in the main component can be also increased to about 7.5 to 8.5% by weight. By using this main component, a flexible material can be selected for the hardener, as the hardener having favorable effects on the pot life, by using alicyclic polyamine, polyamide polyamine, aliphatic polyamine, or epoxide adduct, either alone or in a mixture of two or more kinds, as the hardener, a sufficient pot life is assured, and the amount of active hydrogen in curing process is increased, and by using alicyclic polyamine, in particular, a two-part reactive cold-setting epoxy resin further enhanced in heat resistance is realized. The pot life can be specifically extended to about 3 to 3.5 hours, for example, when the temperature is about 30° C. when kneading the neutron shielding materials containing this two-part reactive cold-setting epoxy resin, and hence the possible pouring time is increased, and massive kneading neutron shielding materials is possible, and the number of times of interruption is decreased in the process of forming a large-sized neutron shield, so that the time and labor required in forming the neutron shield may be substantially saved.

The neutron shield according to another aspect of this invention has a two-part reactive cold-setting epoxy resin consisting of an epoxy resin adding long-chain aliphatic glycidyl ether epoxy resin as main component, and alicyclic polyamine, polyamide polyamine, aliphatic polyamine and epoxy adduct as hardener, a refractory composed of aluminum hydroxide or magnesium hydroxide, and a neutron absorbing material. Pyrolysis temperature of aluminum hydroxide for inducing massive moisture release at high temperature is generally 245 to 320° C., whereas the dehydration pyrolysis temperature of magnesium hydroxide is 340 to 390° C. Since magnesium hydroxide is used in part or whole of the refractory for composing the neutron shield, the heat resistance of the neutron shield in high temperature environment is enhanced.

The cask according to still another aspect of this invention uses the neutron shield described above. The cask further comprises plural square pipes having neutron absorbing capability inserted in a cavity of a shell main body for shielding gamma-rays, shaping according to the outer shape of a basket of square sectional shape formed by the square pipes, and containing and storing spent fuel assemblies in each cell of the basket inserted into the cavity. Since the long-chain aliphatic glycidyl ether epoxy resin containing reactive diluent is used as the main component, the viscosity can be lowered to about 20 to 25 poise, and therefore, the working efficiency is enhanced. Furthermore, the hydrogen content in the main component can be also increased to about 7.5 to 8.5% by weight. By using this main component, a flexible material can be selected for the hardener, as the hardener having favorable effects on the pot life, by using alicyclic polyamine, polyamide polyamine, aliphatic polyamine, or epoxide adduct, either alone or in a mixture of two or more kinds, as the hardener, a sufficient pot life is assured, and the amount of active hydrogen in curing process is increased, and by using alicyclic polyamine, in particular, a two-part reactive cold-setting epoxy resin further enhanced in heat resistance is realized. The pot life can be specifically extended to about 3 to 3.5 hours, for example, when the temperature is about 30° C. when kneading the neutron shielding materials containing this two-part reactive cold-setting epoxy resin, and hence the possible pouring time is increased, and massive kneading neutron shielding materials is possible, and the number of times of interruption is decreased in the process of forming a large-sized neutron shield, so that the time and labor required in forming the neutron shield may be substantially saved.

Other objects and features of this invention will become apparent from the following description with reference to the accompanying drawings.

DESCRIPTION OF THE PREFERRED EMBODIMENTS

Figure 1:
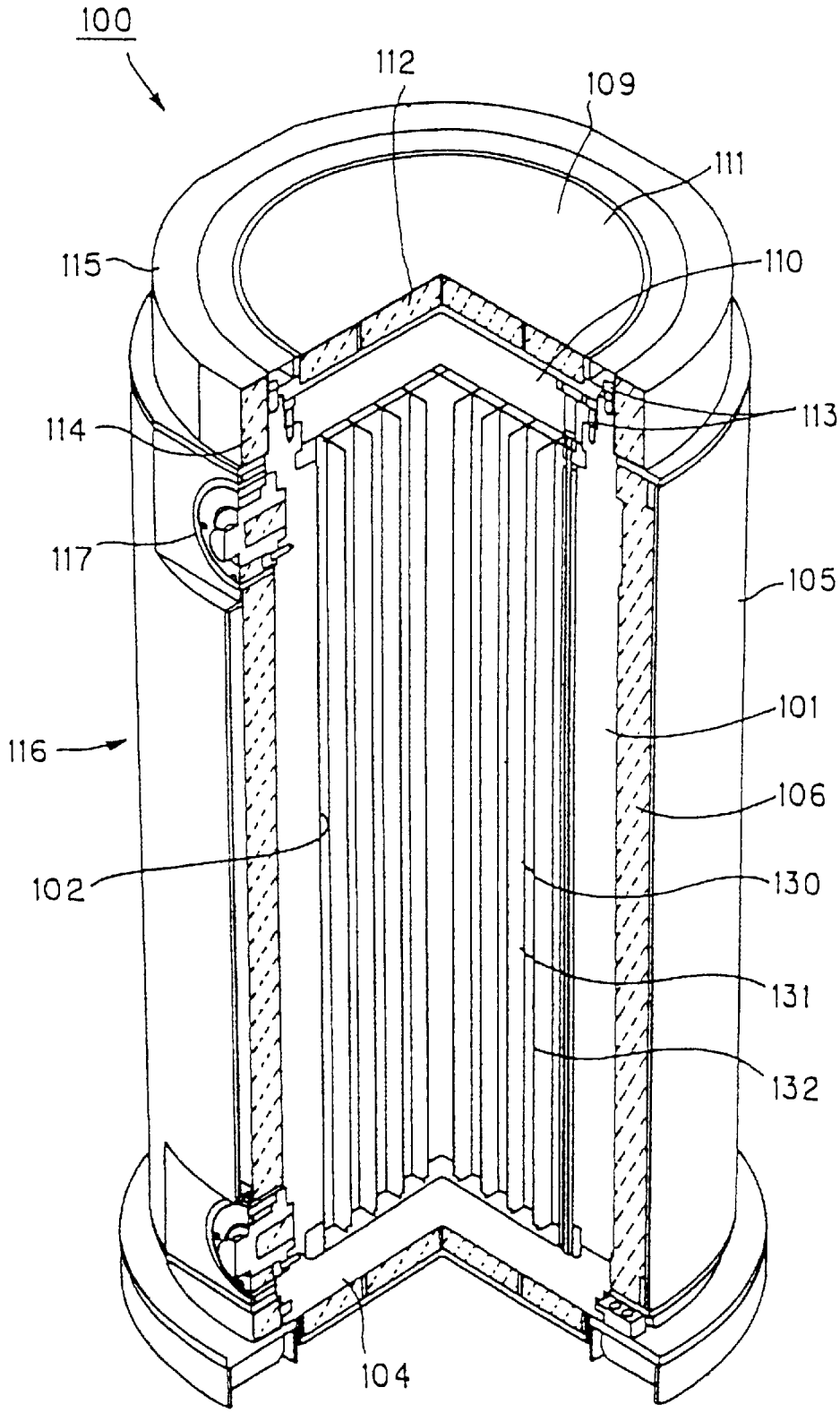
FIG. 1 is a perspective view showing a structure of a cask according to the invention.

Referring now to the accompanying drawings, the neutron shield of the invention, and the cask using the same are described in specific embodiments. It must be noted, however, that the invention is not limited to these embodiments alone.

A neutron shield of the invention is described below. The neutron shield of the first embodiment is a mixture of a two-part reactive cold-setting epoxy resin consisting of main component and hardener, aluminum hydroxide, and boron carbide. The two-part reactive cold-setting epoxy resin is, as the name suggests, an epoxy resin which is cured at ordinary temperature as the main component and hardener are mixed. The aluminum hydroxide is blended in a large quantity, and is large in hydrogen content, and it has functions as refractory and neutron shielding material. The boron carbide is contained in a slight quantity, and it has functions of neutron decelerating agent and absorbing material.

As the main component of the two-part reactive cold-setting epoxy resin, a long-chain aliphatic glycidyl ether epoxy resin containing reactive diluent is used. This long-chain aliphatic glycidyl ether epoxy resin containing reactive diluent has an epoxy equivalent nearly same as the epoxy equivalent of bisphenol A type (=184 to 194), but as compared with the viscosity of bisphenol A type (=120 poise), it is about 20 to 25 poise, and a low viscosity is realized. The hydrogen content of this long-chain aliphatic glycidyl ether epoxy resin containing reactive diluent is 7.6% by weight, which is larger as compared with hydrogen content of 7.1% by weight of bisphenol A type.

Therefore, by using the long-chain aliphatic glycidyl ether epoxy resin containing reactive diluent as the main component of the two-part reactive cold-setting epoxy resin, the working efficiency at ordinary temperature is enhanced owing to its low viscosity. That is, by shortening the time required for kneading, the pot life may be utilized advantageously, and massive kneading is possible, the interruption time is shorter in manufacture of a large-sized neutron shield, and the time required for each pouring process is shortened owing to the fluidity, so that the overall working efficiency notably enhanced.

Moreover, since the long-chain aliphatic glycidyl ether epoxy resin containing reactive diluent is high in hydrogen content, the heat resistance and neutron shielding capability are further enhanced.

On the other hand, by using the long-chain aliphatic glycidyl ether epoxy resin containing reactive diluent as the main component of the two-part reactive cold-setting epoxy resin, the corresponding hardener of the two-part reactive cold-setting epoxy resin can be selected from a wide range, and materials excellent in heat resistance or curing reaction speed can be flexibly selected. Herein, a hardener mixing alicyclic polyamine, polyamide aliphatic polyamine, and epoxy adduct is used. The specific composition is 30% by weight of alicyclic polyamine, 20% by weight of polyamide aliphatic polyamine, and 50% by weight of epoxy adduct.

By thus selecting the blend of the hardener, the curing reaction speed of the amine hardener can be slowed down, and a sufficient pot life is maintained. For example, by keeping the initial temperature in kneading constantly at 30° C., the pot life can be improved to 3 to 3.5 hours. As a result, in addition to the low viscosity of the main component, the working efficiency is further enhanced. Besides, since the selected alicyclic polyamine is high in heat resistance, the refractory performance of the aluminum hydroxide can be enhanced. Moreover, the hydrogen content of the hardener of this selected blend is maintained at 12+/−0.5% by weight, and hence together with the main component, the high hydrogen content may be assured sufficiently.

The boron carbide slightly contained in the neutron shield is not particularly specified as far as it has a neutron absorbing capability, and other materials having a wide absorption sectional area for slow and thermal neutrons may be used, such as boron nitride, boric acid anhydride, boron iron, orthoboric acid, methaboric acid, and other inorganic boron compound, but boron carbide is particularly preferably.

Next, a second embodiment will be explained. The neutron shield of the first embodiment is composed of a two-part reactive cold-setting epoxy resin consisting of main component and hardener, aluminum hydroxide, and boron carbide, but the aluminum hydroxide contained in a large quantity has been known to drop in the hydrogen content in high temperature environment. Decline of hydrogen content has adverse effects on the heat resistance and neutron shielding capability of the neutron shield. This drop of hydrogen content of aluminum hydroxide is caused by pyrolysis of part of moisture in the aluminum hydroxide in high temperature environment.

Herein, aluminum hydroxide of high purity was blended in the neutron shield, and by lowering the content of soda ($N_{a2}O$) contained in refining process of aluminum hydroxide, it was experimentally confirmed that there was a tendency of suppressing moisture release of part of aluminum hydroxide by pyrolysis up to a high temperature region.

Generally, the dehydration pyrolysis temperature for inducing release of moisture of aluminum hydroxide is 245 to 320°C., and by decreasing the soda content in the refining process of aluminum hydroxide, it is estimated that the hydrogen content is maintained up to this temperature region.

Enhancement of purity of aluminum hydroxide is possible by deposition of aluminum hydroxide in a sufficient time in refining from bauxite. Generally, the soda content contained in a commercial product of aluminum hydroxide is 0.2 to 0.3% by weight, and in this case the dehydration pyrolysis temperature of aluminum hydroxide is 120° C. or more, but by controlling the soda content at 0.1% by weight, the dehydration pyrolysis temperature of aluminum hydroxide can be held up to about 150° C. or more. In particular, by controlling the soda content contained in the aluminum hydroxide at 0.07% by weight or less, the weight loss by heat due to dehydration could be suppressed to 150 to 160° C. Refining of aluminum hydroxide with the soda content of 0.07% by weight or less may be easily achieved by taking enough time for depositing as mentioned above, or by washing the commercial aluminum hydroxide in water.

By blending the aluminum hydroxide of high purity in the neutron shield, the hydrogen content can be maintained even in high temperature environment. In particularly, by controlling at low soda content of 0.07% by weight or less, the hydrogen content may be held up to about 150 to 160° C. This hydrogen content held at 150 to 160° C. is enough for the neutron shield used in the cask as mentioned later.

In the second embodiment, the neutron shield blended with aluminum hydroxide of high purity is explained to be used in the neutron shield described in the first embodiment, but it is commonly applied in the neutron shield blended with aluminum hydroxide.

Next, a third embodiment will be explained. Since the neutron shield in the first embodiment is composed of a two-part reactive cold-setting epoxy resin consisting of main component and hardener, aluminum hydroxide, and boron carbide, generally, the dehydration pyrolysis temperature of aluminum hydroxide is 245 to 320° C., and it is sometimes desired to hold the hydrogen content in a region below this temperature range.

Herein, since the dehydration pyrolysis temperature of magnesium hydroxide is 340 to 390° C., by using magnesium hydroxide as the refractory for composing the neutron shield, the heat resistance of the neutron shield in high temperature environment may be further enhanced.

In the third embodiment, magnesium hydroxide is used in place of aluminum hydroxide to be blended in the neutron shield described in the first embodiment, but this blending of magnesium hydroxide is commonly applied in the neutron shield.

Also in the third embodiment, magnesium hydroxide is used in place of aluminum hydroxide, but part of aluminum hydroxide may be replaced by magnesium hydroxide.

Next, a fourth embodiment will be explained. In the fourth embodiment, the neutron shield explained in the first to third embodiments is applied as the neutron shield of the cask. The cask is a container for holding and storing the spent fuel assemblies. In the terminal stage of nuclear fuel cycle, the consumed fuel assemblies no longer usable are called spent fuels. The spent fuels contain FP and highly radioactive substances, and must be cooled thermally, and hence they are cooled for a specified period (3 to 6 months) in cooling pits at nuclear power plants. Then they are transferred into the shielded container called cask, and transported by truck or ship, and stored at reprocessing plants.

Figure 2:
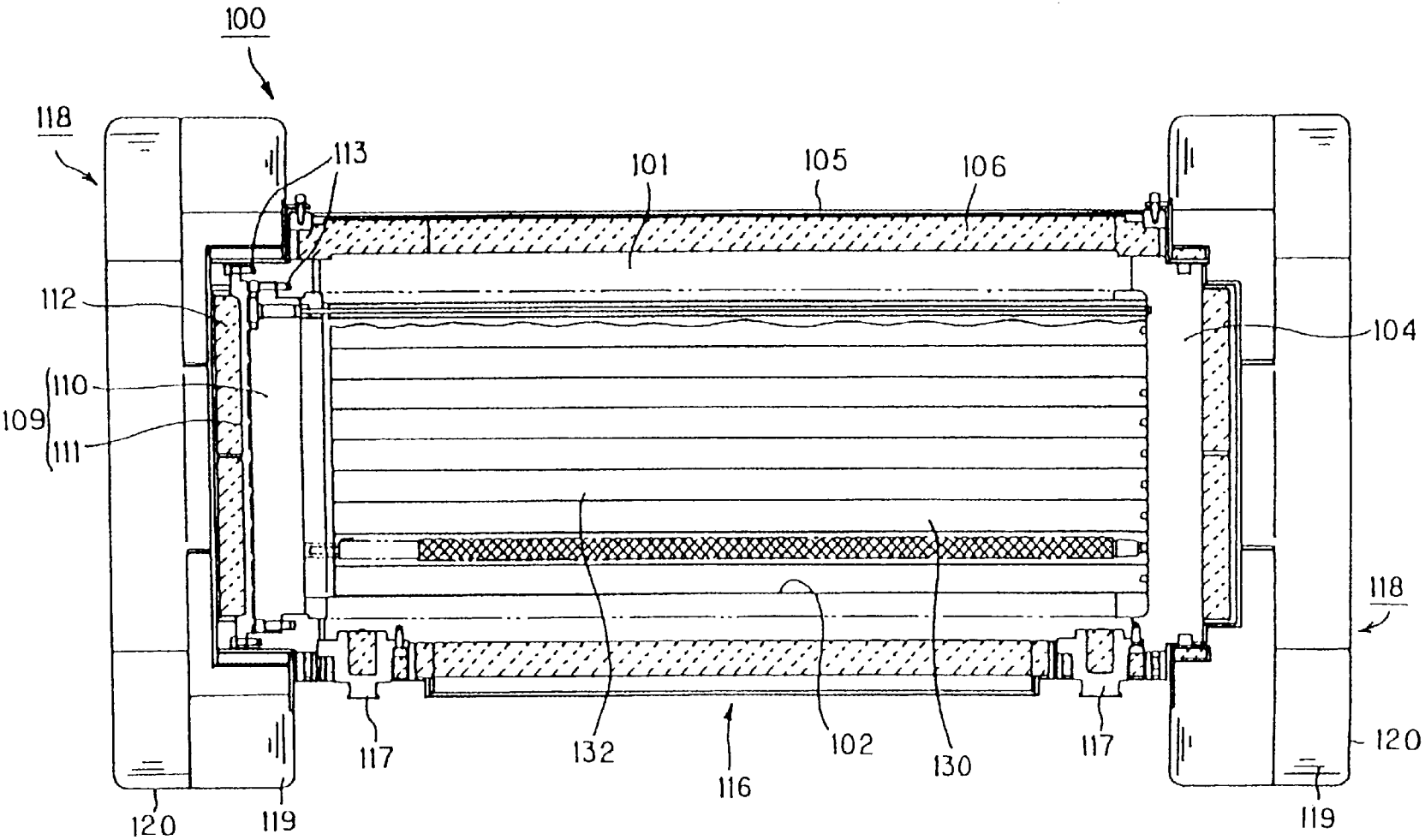
FIG. 2 is an axial direction sectional view showing the structure of the cask shown in FIG. 1.
Figure 3:
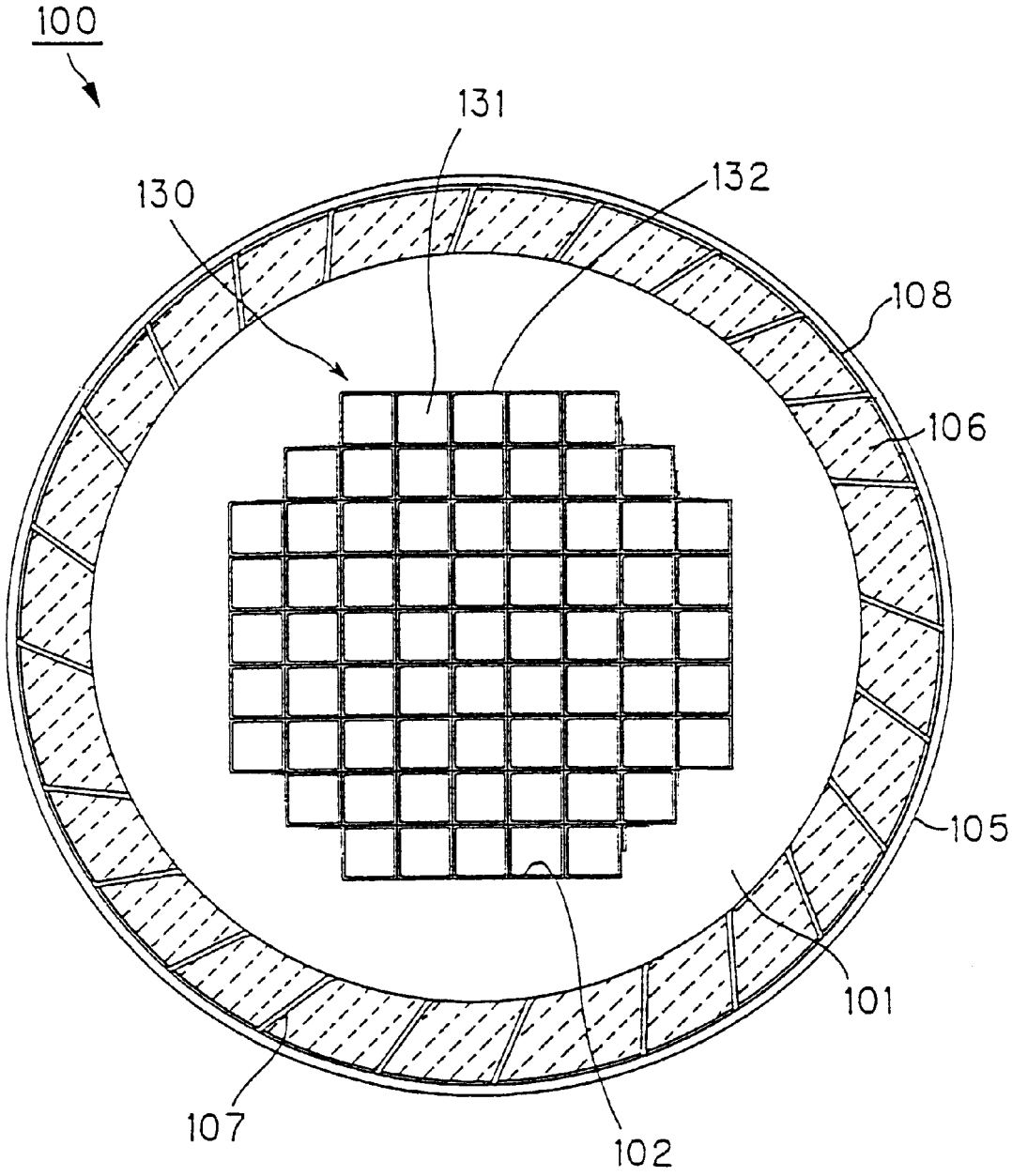
FIG. 3 is a radial direction sectional view showing the structure of the cask shown in FIG. 1.

FIG. 1 is a perspective view of a cask. FIG. 2 is an axial direction sectional view of the cask shown in FIG. 1. FIG. 3 is a radial direction sectional view of the cask shown in FIG. 1. A cask 100 is formed by machining the inner circumference of a cavity 102 of a shell main body 101 according to the outer circumferential shape of a basket 130. The inner surface of the cavity 102 is machined by exclusive milling machine or the like. The shell main body 101 and bottom plate 104 are carbon steel forged parts having gamma-ray shielding function. Instead of carbon steel, stainless steel may be also used. The shell main body 101 and bottom plate 104 are bonded by welding. To maintain an enclosed performance as a pressure-tight container, a metal gasket is placed between a primary lid 110 and the shell main body 101.

The space between the shell main body 101 and outer tube 105 is filled with a neutron shielding resin 106, or the neutron shield mentioned above, which is a high polymer material with high hydrogen content. Plural copper inner fins 107 for heat conduction are welded between the shell main body 101 and outer tube 105, and the resin 106 is injected into the space formed by the inner fins 107 in a fluid state through a pipe not shown herein, and is cooled and solidified. The inner fins 107 should be preferably provided at high density in the area of large heat generation in order to cool uniformly. A thermal expansion allowance 108 of about several millimeters is provided between the resin 106 and outer tube 105. The thermal expansion allowance 108 is formed by disposing an extinguishing type outer tube 105 having a heater buried in hot-melt adhesive or the like at the inner side, injecting and solidifying the resin 106, and heating the heater for melting and discharging.

A lid 109 is composed of a primary lid 110 and a secondary lid 111. The primary lid 110 is a disc of stainless steel or carbon steel for shielding gamma-rays. The secondary lid 111 is also a disc of stainless steel or carbon steel, but its upper surface is coated with a neutron shielding resin 112, that is, the neutron shield as mentioned above. The primary lid 110 and secondary lid 111 are fitted to the shell main body 101 by stainless steel or carbon steel bolts 113. Further, among the primary lid 110, secondary lid 111, and shell main body 101, metal gaskets are provided, and the inside is kept airtight. The lid 109 is surrounded with an auxiliary shield 115 sealed with resin 114.

At both sides of the cask main body 116, trunnions 117 are provided for suspending the cask 100. In FIG. 1, the auxiliary shield 115 is provided, but when conveying the cask 100, the auxiliary shield 115 is detached, and a buffer 118 is attached instead (see FIG. 2). The buffer 118 has a structure of assembling a buffer material 119 such as redwood into an outer tube 120 formed of a stainless steel material. A basket 130 is composed of 69 square pipes 132 for forming a cell 131 for containing the spent fuel assemblies. The square pipes 132 are composed of aluminum composite material or aluminum alloy formed by adding powder of B or B compound having neutron absorbing performance to Al or Al alloy powder. As the neutron absorbing material, cadmium may be also used instead of boron.

The cask 100 mentioned herein is a huge structure of 100-ton class, and by using the neutron shield explained in the first to third embodiments as the resin 106, 112, 114, the weight is reduced substantially, and a sufficient neutron shielding performance and heat resistance will be achieved, and even in locations having a complicated structure such as the inner fins 107, by the improvement of fluidity and pot life, the time and labor required in pouring of the resin 106, 112, 114 can be saved substantially.

As described herein, according to the neutron shield and the cask of the invention, since the long-chain aliphatic glycidyl ether epoxy resin containing reactive diluent is used as the main component, the viscosity can be lowered to about 20 to 25 poise, and therefore, the working efficiency is enhanced. Furthermore, the hydrogen content in the main component can be also increased to about 7.5 to 8.5% by weight. By using this main component, a flexible material can be selected for the hardener, as the hardener having favorable effects on the pot life, by using alicyclic polyamine, polyamide polyamine, aliphatic polyamine, or epoxide adduct, either alone or in a mixture of two or more kinds, as the hardener, a sufficient pot life is assured, and the amount of active hydrogen in curing process is increased, and by using alicyclic polyamine, in particular, a two-part reactive cold-setting epoxy resin further enhanced in heat resistance is realized. The pot life can be specifically extended to about 3 to 3.5 hours, for example, when the temperature is about 30° C. when kneading the neutron shielding materials containing this two-part reactive cold-setting epoxy resin, and hence the possible pouring time is increased, and massive kneading neutron shielding materials is possible, and the number of times of interruption is decreased in the process of forming a large-sized neutron shield, so that the time and labor required in forming the neutron shield may be substantially saved.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A neutron shield comprising a two-part reactive cold-setting epoxy resin produced by combining a main component of an aliphatic glycidyl ether epoxy resin, and a hardener comprising at least one of an alicyclic polyamine, a polyamide polyamine, an aliphatic polyamine and an epoxy adduct.

2. The neutron shield according to claim 1, further comprising boron carbide.

3. The neutron shield according to claim 1, further comprising aluminum hydroxide containing 0.1% by weight or less of soda.

4. The neutron shield according to claim 1, further comprising aluminum hydroxide containing 0.07% by weight or less of soda.

5. A neutron shield comprising a two-part reactive cold-setting epoxy resin produced by combining a main component of an aliphatic glycidyl ether epoxy resin;

a hardener comprising at least one of an alicyclic polyamine, a polyamide polyamine, an aliphatic polyamine and an epoxy adduct;

a refractory comprising at least one of aluminum hydroxide and magnesium hydroxide; and a neutron absorbing material.

6. The neutron shield according to claim 5, wherein the aluminum hydroxide contains 0.1% by weight or less of soda.

7. The neutron shield according to claim 5, wherein the aluminum hydroxide contains 0.07% by weight or less of soda.

8. A cask comprising:

a neutron shield comprising a two-part reactive cold-setting epoxy resin produced by combining a main component of an aliphatic glycidyl ether epoxy resin, and a hardener comprising at least one of an alicyclic polyamine, a polyamide polyamine, an aliphatic polyamine and an epoxy adduct, wherein the neutron shield is disposed on the outer circumference of the cask;

a shell main body which can shield gamma-rays;

a basket formed of a plurality of square pipes having neutron absorbing capability, where the basket has a cross section which has angles, and the basket is for housing spent fuel assemblies in each square pipe; and a cavity for inserting the basket, where the inner shape of the cavity is in accordance with the outer shape of the basket.

9. A cask comprising:

a neutron shield comprising a two-part reactive cold-setting epoxy resin produced by combining a main component of an aliphatic glycidyl ether epoxy resin, and a hardener comprising at least one of an alicyclic polyamine, a polyamide polyamine, an aliphatic polyamine and an epoxy adduct, a refractory comprising at least one of aluminum hydroxide and magnesium hydroxide, and a neutron absorbing material, where the neutron shield is disposed on the outer circumference of the cask;

a shell main body which can shield gamma-rays;

a basket formed of a plurality of square pipes having neutron absorbing capability, where the basket has a cross section which has angles, and the basket is for housing spent fuel assemblies in each square pipe; and a cavity for inserting the basket, where the inner shape of the cavity is in accordance with the outer shape of the basket.

10. A method of making a neutron shield, the method comprising curing a mixture of an aliphatic glycidyl ether epoxy resin, and a hardener comprising at least one of an alicyclic polyamine, a polyamide polyamine, an aliphatic polyamine and an epoxy adduct; and producing the neutron shield of claim 1.

11. A method of making a neutron shield, the method comprising curing a mixture of an aliphatic glycidyl ether epoxy resin, a hardener comprising at least one of an alicyclic polyamine, a polyamide polyamine, an aliphatic polyamine and an epoxy adduct;

a refractory comprising at least one of aluminum hydroxide and magnesium hydroxide; and a neutron absorbing material, and producing the neutron shield of claim 5.

12. A method of making a cask, the method comprising forming a neutron shield by curing a mixture of an aliphatic glycidyl ether epoxy resin; and a hardener comprising at least one of an alicyclic polyamine, a polyamide polyamine, an aliphatic polyamine and an epoxy adduct, and using the neutron shield to produce the cask of claim 8.

13. A method of making a cask, the method comprising forming a neutron shield by curing a mixture of an aliphatic glycidyl ether epoxy resin;

a hardener comprising at least one of an alicyclic polyamine, a polyamide polyamine, an aliphatic polyamine and an epoxy adduct;

a refractory comprising at least one of aluminum hydroxide and magnesium hydroxide; and a neutron absorbing material, and using the neutron shield to produce the cask of claim 9.

* * * * *